US007269855B2

(12) United States Patent
LaRocco

(10) Patent No.: US 7,269,855 B2
(45) Date of Patent: Sep. 18, 2007

(54) FOLDABLE, DECORATIVE ADULT BIB

(76) Inventor: Caroline L. LaRocco, 4304 Charlemagne Cir., Pittsburgh, PA (US) 15237

( * ) Notice: Subject to any disclaimer, the term of this patent is extended or adjusted under 35 U.S.C. 154(b) by 105 days.

(21) Appl. No.: 11/231,015

(22) Filed: Sep. 20, 2005

(65) Prior Publication Data

US 2006/0059597 A1 Mar. 23, 2006

Related U.S. Application Data

(60) Provisional application No. 60/611,327, filed on Sep. 20, 2004.

(51) Int. Cl.
*A41B 13/10* (2006.01)

(52) U.S. Cl. ..... 2/49.1; 2/49.2

(58) Field of Classification Search ..... 2/49.1, 2/49.2, 49.4, 49.5, 48, 49.3, 46, 52, 51, 50, 2/88, 69.5, 93, 94, 102; D2/860–864
See application file for complete search history.

(56) References Cited

U.S. PATENT DOCUMENTS 115,238 A * 5/1871 Raiford ..... 24/9
1,797,208 A * 3/1931 Weisz ..... 2/51
2,579,383 A * 12/1951 Goudsmit ..... 219/211
2,631,288 A * 3/1953 Daust ..... 2/49.3
4,625,337 A 12/1986 Zahn
5,244,278 A * 9/1993 Robitaille ..... 383/4
5,328,265 A 7/1994 Clooney
5,410,758 A * 5/1995 Dupont et al. ..... 2/51
5,483,701 A 1/1996 Ferreyros
5,799,336 A 9/1998 Cooper
6,000,056 A * 12/1999 Brady et al. ..... 2/49.1
6,243,873 B1 * 6/2001 Aliff ..... 2/88
6,345,392 B1 * 2/2002 Rios ..... 2/48
6,742,189 B2 * 6/2004 Bennett ..... 2/49.2
6,799,330 B1 * 10/2004 Lansdell ..... 2/49.4
6,859,938 B1 * 3/2005 Niski et al. ..... 2/49.1
7,100,211 B2 * 9/2006 Bruffett ..... 2/49.2

* cited by examiner

*Primary Examiner*—A. Vanatta
(74) *Attorney, Agent, or Firm*—The Webb Law Firm

(57) ABSTRACT

An aesthetically pleasing and functional bib utilizes an integral pouch for storage and transportation of the bib. The bib includes a bib body having a top portion, a bottom edge, a front portion and a rear portion. The pouch includes an open end, wherein the pouch is secured between the front portion and the rear portion such that the open end of the pouch is situated substantially along the bottom edge of the bib. A sleeve is formed near the top portion, wherein a neck attachment member is partially secured therein. The neck attachment member is a partial loop having spring memory. The pouch is adapted to move from a tucked position within a cavity defined by the front and rear portions to an untucked position external to the cavity. Fasteners secure portions of the bib during folding thereof. A method of folding a bib for storage and transportation thereof is also disclosed.

20 Claims, 6 Drawing Sheets

FOLDABLE, DECORATIVE ADULT BIB

CROSS REFERENCE TO RELATED APPLICATION

This application claims priority to U.S. Provisional Application No. 60/611,327 entitled "Foldable, Decorative Adult Bib," filed Sep. 20, 2004, which is incorporated herein by reference in its entirety.

BACKGROUND OF THE INVENTION

1. Field of the Invention

The present invention relates generally to a bib and, more particularly, a decorative combined bib and storage pouch for an adult.

2. Description of Related Art

Generally, fashion clothing is constructed of beautiful and expensive fabric that is usually susceptible to staining resulting from spillage of food or beverage on the clothing. Such fine fabrics are not easily washable and the use of dry cleaning shortens the life of the fabric. Additionally, any specialized cleaning has increased financial costs associated therewith. Furthermore, there is no guarantee that the staining may be removed even after the cleaning-related time and financial costs have been incurred.

Immediately after food or beverage has been spilled on the fabric, the general procedure followed is to dab the affected area of the fabric with water (e.g., soda water). However, this clumsy display draws attention to oneself and the spillage incident. Accordingly, as a preventative measure, individuals may tuck a dinner napkin into their collar to avoid these mishaps. However, the dinner napkin usually falls out, requires constant readjustment, or is otherwise uncomfortable. Furthermore, use of the dinner napkin as a bib has become disfavored among the general population, with the exception of children and the elderly, as it is viewed as poor dining etiquette.

U.S. Pat. No. 5,483,701 to Ferreyros discloses a child's bib that includes an integral pouch situated along a neckline thereof that is used to store the bib therein. Although this design may be suitable for children, the appearance, both from a fabric design and overall cut or dimension standpoint, does not provide a sophisticated look and feel that is appropriate for an adult. Additionally, the prior art bib does not provide for automatic size adjustment of the securement mechanism thereof around the neck of the individual. A form-fit around the neck may require multiple steps or readjustment of the securement mechanism. Furthermore, the prior art bib does not provide extended anatomical coverage for an area below the waist of the individual. Thus, there is a need for a protective bib that is both aesthetically pleasing and functional for adult use.

SUMMARY OF THE INVENTION

Accordingly, I have invented an aesthetically pleasing and functional bib having a pocket or pouch that is used for storage and transportation of the bib. The bib includes a bib body having a front portion at least partially attached to a rear portion, defining a cavity therein. Additionally, the bib includes a pouch having a first side, a second side and an open end, wherein a portion of the first side of the pouch is attached substantially adjacent an edge of the front portion of the bib body and a portion of the second side of the pouch is attached substantially adjacent an edge of the rear portion of the bib body. The left side of the front portion corresponds to the right side of the rear portion, and the right side of the front portion corresponds to the left side of the rear portion. The body may be constructed of fabric having a decorative design.

The pouch is adapted to move from a tucked position, where the pouch is situated within the cavity defined between the front portion and the rear portion of the bib body, and an untucked position, where the pouch is situated in a position external to the cavity and the pouch extends from the bib body.

Furthermore, a neck attachment member is secured to a top portion of the body, which may be tapered. The neck attachment member is configured to engage the neck of the user. The bib includes a sleeve formed near the top portion, wherein the neck attachment member is partially received therethrough. The neck attachment member may be a partial loop having spring memory, which may be constructed of metal, plastic, rubber, fiber or any combination thereof. The neck attachment member and the bib body are configured to be compacted and received within the pouch.

The bib may also include a first and second fastening connector, wherein the first fastening connector is secured to the right side of the front portion of the body and the second fastening connector is secured to the central portion of the front portion of the body, and wherein the first fastening connector is adapted to mate with the second fastening connector. The bib may further include a third and fourth fastening connector, wherein the third fastening connector is secured to the left side of the front portion of the body and the fourth fastening connector is secured to the left side of the rear portion of the body, and wherein the third fastening connector is adapted to mate with the fourth fastening connector. The fastening connectors may be corresponding snap fasteners, magnets, buttons and button holes, hook and loop closures, or any combination thereof.

An alternative embodiment of the bib includes a unitary fabric material having an underneath portion configured to at least partially cover a front torso of an individual; a neck portion extending from the underneath portion; and an outer portion extending from the neck portion, and configured to at least partially cover the front torso and at least partially overlap the underneath portion. Further, the width of the neck portion is preferably less than the width of the outer portion, the underneath portion, or any combination thereof. A first fastening connector is attached to a front surface of the underneath portion and a second fastening connector is attached to a rear surface of the outer portion, wherein the first fastening connector and the second fastening connector are aligned and adapted to mate. The bib also includes a button secured to a front side of the outer portion such that the attachment point of the button substantially corresponds to the location of the second fastening connector on the back side of the outer portion.

The present invention also includes a method of folding a bib for transportation thereof. Generally, a bib is provided that includes a bib body having a top portion, a bottom portion and an integral pouch with the integral pouch adapted to receive the bib body therein. The integral pouch includes an open end situated along the bottom portion and the top portion is adapted to secure the neck attachment member thereto. Next, a first fold line and a second fold line are established along the length of the bib body, wherein the first fold line is situated approximately two-thirds the distance of the width of the bib body, and the second fold line is situated approximately one-third the distance of the width of the bib body. A first side of the bib body is folded along the first fold line and a second side of the bib body is folded along the second fold line to cause the second side of the bib body to overlap the first side of the bib body. Next, a third fold line is established along the width of the bib body, wherein the third fold line is situated approximately one-third the distance from the top portion to the bottom portion. Next a hand is inserted into the pouch and the neck attachment member is grasped. Finally, the neck attachment member is pulled through the open end of the integral pouch, whereby the pouch is inverted and the bib is contained within the pouch. Optionally, the first side of the bib body may be fastened to a central portion of the bib and the second side of the bib body may be fastened to the first side of the bib.

The present invention provides an adult diner with an easy to use, aesthetically pleasing and attractive bib to reduce or eliminate the possibility of food or beverage staining from occurring on the diner's clothing. Accordingly, the diner is provided with a carefree dining experience without worrying about potential staining and embarrassment due to such staining. The bib is designed for efficient transport to and from a dining establishment in an attractive self-contained pouch.

Still other desirable features of the invention will become apparent to those of ordinary skill in the art upon reading and understanding the following detailed description, taken with the accompanying drawings, wherein like reference numerals represent like elements throughout.

DESCRIPTION OF THE PREFERRED EMBODIMENTS

The present invention will now be described with reference to the accompanying figures. It is to be understood that the specific system illustrated in the attached figures and described in the following specification is simply an exemplary embodiment of the present invention.

With reference to FIGS. 1-5, a bib 10 according to a first embodiment of the present invention is disclosed. The bib includes a bib body 12, a pouch 14, and a neck attachment member 16.

Figure 1:
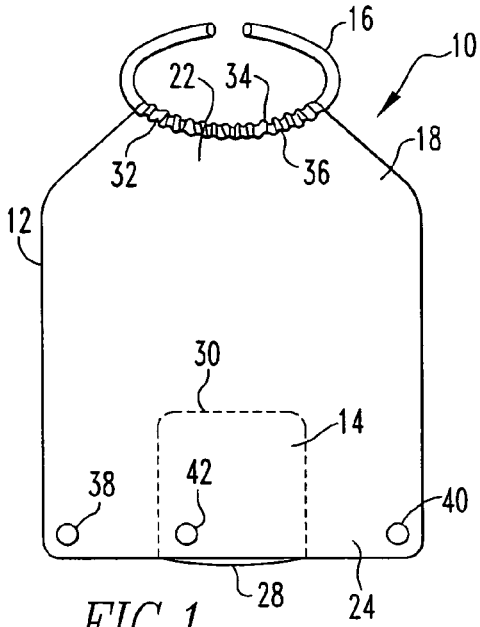
FIG. 1 is a front view of a first embodiment of a bib in accordance with the present invention.
Figure 2:
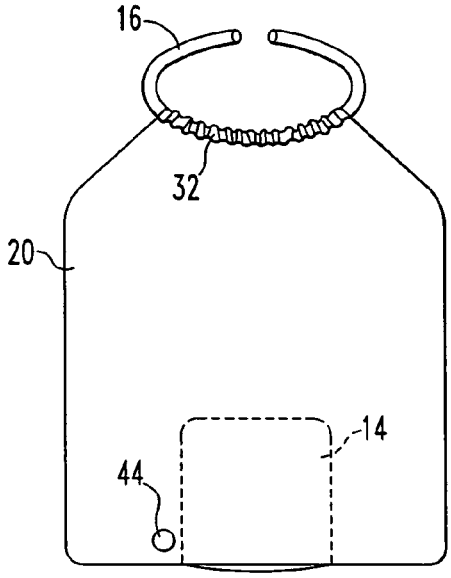
FIG. 2 is a rear view of the bib of FIG. 1.

As specifically shown in the front and rear views of the bib 10 in FIGS. 1 and 2, the bib body 12 of the bib 10 includes a front portion 18 facing away from the wearer, a rear portion 20 resting against the wearer, a top portion 22 and a bottom portion 24. Desirably, the bottom portion 24 is substantially rectilinear and the top portion 22 is tapered, such that the tapered portion extends to the area of the bib 10 where the neck attachment member 16 is secured. The bib body 12 is desirably constructed of fabric that may be decoratively imprinted and/or textured. An exemplary fabric is polyester or polyester-blend fabrics that are conducive to quick clean-up and spill-resistance. However, it is to be understood that other fabrics, natural or synthetic, or other materials, such as plastic may be used in the construction of the bib body 12. The bib 10 may be decorated with embroidery, lace, or any other decoration, including names or initials.

Figure 4:
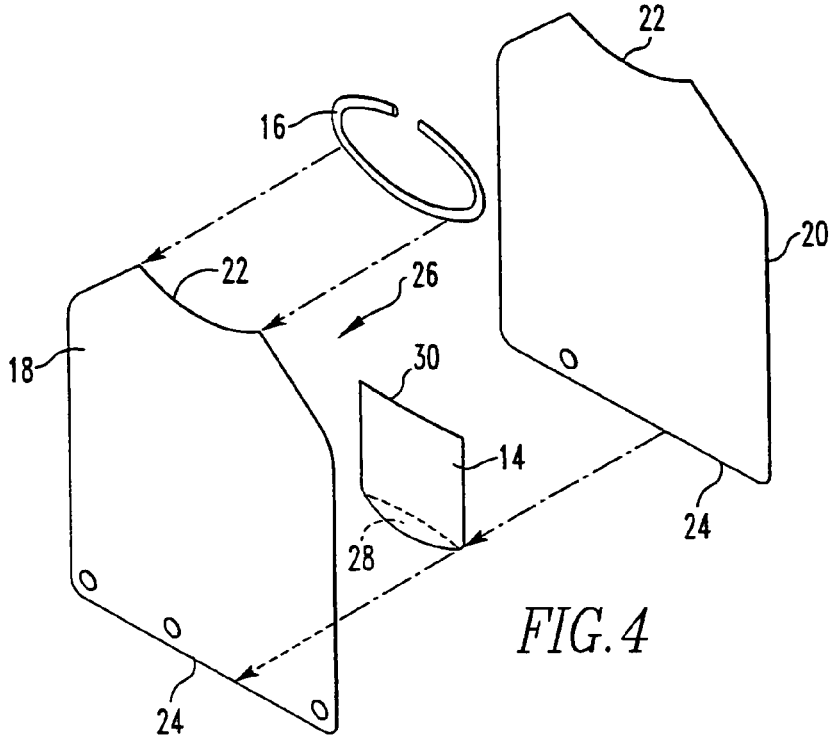
FIG. 4 is an exploded perspective view of the constituent parts of the bib of FIG. 1.
Figure 5:
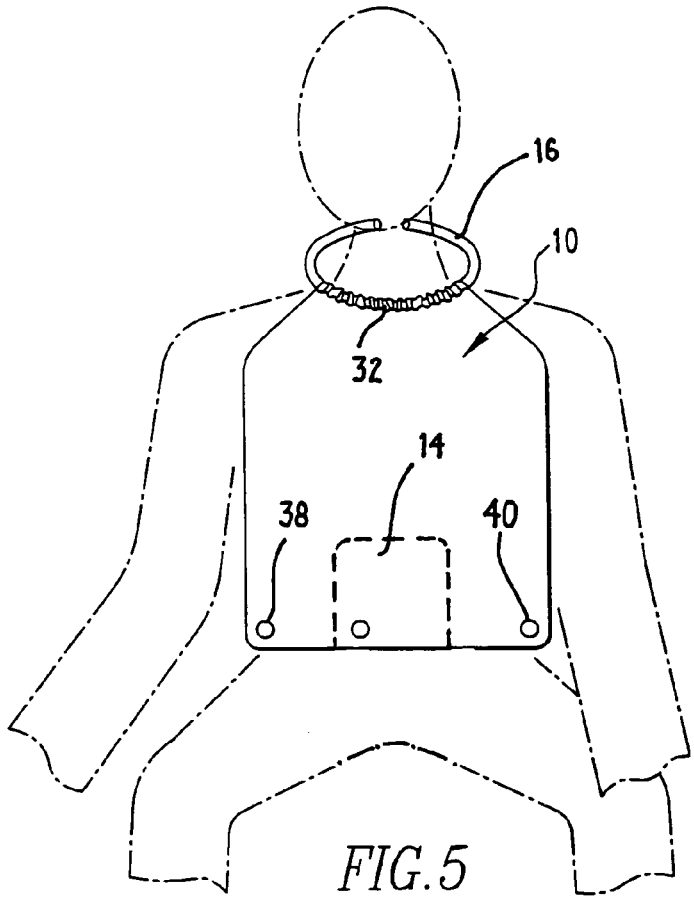
FIG. 5 is a front view of the bib of FIG. 1, as worn by an individual.

As shown in the exploded perspective view of FIG. 4, the front portion 18 and the rear portion 20 are two separate pieces of fabric that are joined together along their edges thereof. However, it is to be understood that the front and rear portions 18, 20 may alternatively be embodied as a unitary piece. Desirably, the front and rear portions 18, 20 are secured to each other via sewn thread, however, it is to be understood that other suitable methods of joining may be utilized including, but not limited to, stapling, gluing, or melting. Accordingly, a cavity 26 is formed for accommodating the pouch 14 between the front and rear portions 18, 20. Desirably, the bottom edges of the front and rear portions 18, 20 are only partially joined so as to allow the pouch 14 to be integrally secured to the bib body 12 and be removed from the cavity 26.

Accordingly, the pouch 14 may be moved from a tucked position to an untucked position. The tucked position corresponds to placement of the pouch 14 within the cavity 26, whereas the untucked position corresponds to removal of the pouch 14 from the cavity 26. The pouch 14 is sized to accommodate the entire bib 10 therein, desirably, in a folded state. Desirably, the pouch 14 includes an open end 28 and a closed end 30. The open end 28 of the pouch 14 is aligned with a bottom edge or near the bottom edge of the bib 10 that is not joined together. The pouch 14 extends upwardly into the cavity 26 in the tucked position. Removal of the pouch 14 into the untucked position is effected by reaching into the open end 28 of the pouch 14, grasping the closed end 30, and pulling the closed end 30 through the open end 28. Accordingly, the pouch 14 has been inverted and now extends beyond the bib body 12 of the bib 10, as shown in FIG. 3.

The neck attachment member 16 is embodied as a partial loop having a spring memory. The neck attachment member 16 is configured to engage the neck of the user. The spring memory causes the ends of the partial loop to be biased toward each other. Thus, the neck attachment member 16 may be constructed of circular formed wire, unitary, twisted, braided, or otherwise, or another flexible material or construction arrangement. For example, alternate neck attachment members may be constructed of plastic, rubber, fiber, other suitable materials, or any combination thereof.

The neck attachment member 16 is secured to the bib 10 via an integral sleeve 32 formed along the top portion 22 of the bib body 12. The sleeve 32 is formed by first attaching the front portion 18 to the rear portion 20 at or near the top portion 22 of the bib 10 via a first seam 34. Then the front portion 18 is again attached to the rear portion 20 via a second seam 36, at a level below the first seam 34. The resultant sleeve 32 formed by the first and second seams 34, 36 is sized to accommodate the neck attachment member 16 therethrough. Specifically, one of the free ends of the neck attachment member 16 may be slipped into, through, and out of the sleeve 32 such that the neck attachment member 16 is secured to the body 12 via the sleeve 32. The neck attachment member 16 may either be temporarily or permanently secured to the bib 10.

Figure 3:
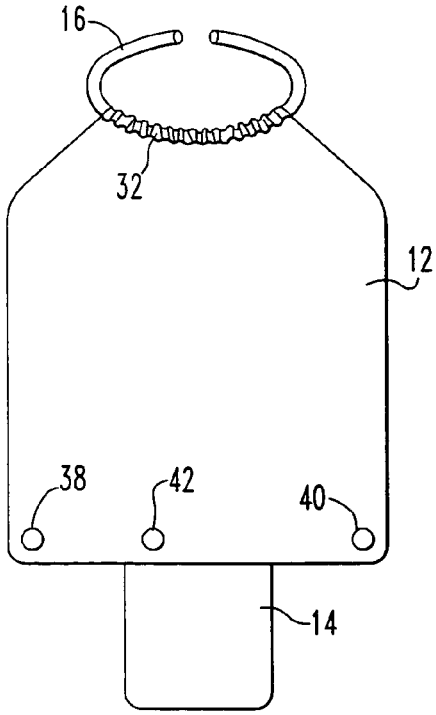
FIG. 3 is a front view of the bib of FIG. 1, with an integral pouch extending from the bib.

As shown in FIGS. 1-3, the bib 10 may also include fasteners to facilitate the folding and placement of the bib 10 into the pouch 14. As shown in FIG. 1, the front of the bib 10 includes a first female fastener 38 and a second female fastener 40 secured to a bottom left and bottom right portion of the body 12, respectively. A first male fastener 42 is secured between the first and second female fasteners 38, 40. Specifically, the first male fastener 42 is situated at a point approximately one-third the distance between the first and second female fasteners 38, 40. As shown in FIG. 2, the rear of the bib 10 includes a second male fastener 44 secured to a left bottom portion of the body 12 along an edge thereof. Specifically, the second male fastener 44 is situated at a point approximately one-third the distance of the width of the bottom portion 24. The first and second female fasteners 38, 40 and the first and second male fasteners 42, 44 are embodied as snaps; however, it is to be understood that the snap fasteners are not to be construed as limiting the invention. Exemplary embodiments of other fasteners or fastening connectors, male, female, or otherwise, include, but are not limited to, magnets, buttons and button holes, hook and loop closures including those marketed under the brand VELCRO® or any combination thereof. Additionally, it is to be understood that the male and female fasteners are interchangeable. For example, the first male fastener 42 may be substituted for the second female fastener 40 if the original second female fastener 40 is substituted with the first male fastener 42. Furthermore, it is to be understood that the placement of the first and second female fasteners 38, 40 and the first and second male fasteners 42, 44 is for exemplary purposes only and that other suitable areas for securing the fasteners may be employed to effect adequate securement of portions of the bib 10 during folding thereof. In an alternative embodiment of the bib 10, use of the aforementioned fasteners may be forgone without departing from the folding and storing functionality of the bib 10.

The bib 10 may be utilized by securing the neck attachment member 16 around the neck of an individual and draping the bib 10 over the chest of the individual. Further, the pouch 14 may either be in the tucked or untucked position during use of the bib 10.

Figure 6:
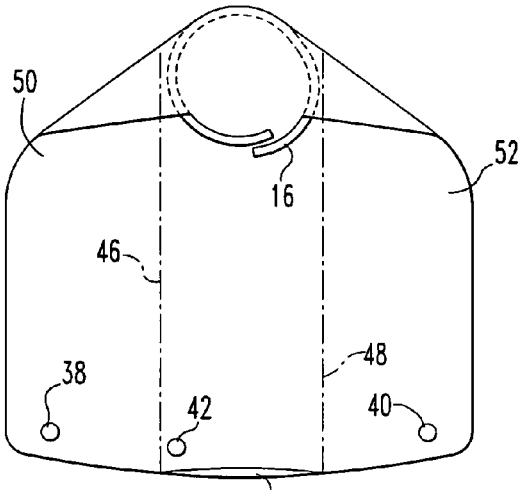
FIG. 6 is a front view depicting an initial folding position for the bib of FIG. 1.
Figure 7:
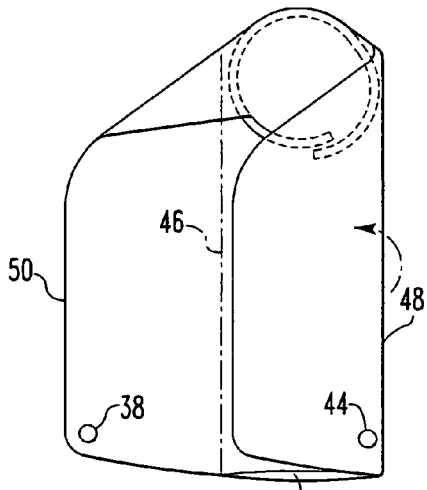
FIG. 7 is a front view depicting the first folding step for folding the bib of FIG. 1.
Figure 8:
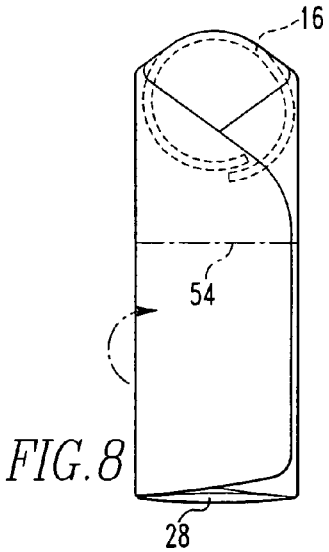
FIG. 8 is a front view depicting the second folding step for folding the bib of FIG. 1.
Figure 9:
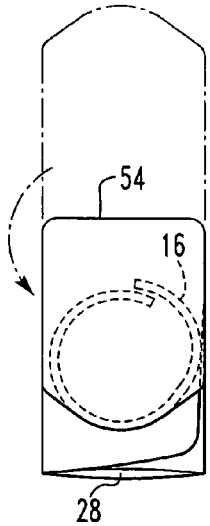
FIG. 9 is a front view depicting the third folding step for folding the bib of FIG. 1.
Figure 10:
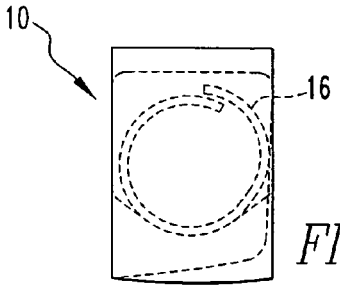
FIG. 10 is a front view depicting the bib of FIG. 1 in a storage or transportation state.

With continuing reference to FIGS. 1-5, the steps of folding the bib 10 to assume a folded state conducive for storage or transportation of the bib 10 is illustrated in FIGS. 6-10. An initial folding position for the bib 10 is disclosed in FIG. 6. Generally, the bib 10 is placed on a flat surface such that the rear portion 20 is facing the flat surface. The neck attachment member 16 is folded inward to lay flat against the front portion 18 of the body 12. FIG. 6 also shows a first imaginary fold line 46 and a second imaginary fold line 48 partitioning the body 12 into thirds lengthwise. Thus, a left side 50 and a right side 52 of the body 12 are demarcated by the first and second imaginary fold lines 46, 48. Next, the right side 52 is folded inward along the second imaginary fold line 48 to line up with the first imaginary fold line 46, as shown in FIG. 7. After completing this fold, the second female fastener 40 is situated adjacent to the first male fastener 42 and may be fastened thereto. Next, the left side 50 is folded inward along the first imaginary fold line 46 to line up with the second imaginary fold line 48, as shown in FIG. 8. The left side 50 now overlaps the right side 52 and the bib 10 is folded in thirds. After completing this fold, the first female fastener 38 is situated adjacent to the second male fastener 44 and may be fastened thereto. Next, the folding neck attachment member 16 is once more folded inward along a third imaginary fold line 54. The third imaginary fold line 54 is situated one-third the distance from the top portion 22 of the body 12 to the bottom portion 24 of the body. After completing this fold, the bib 10 now resembles the depiction in FIG. 9. Finally, the individual inserts his or her hand into the pouch 14 via the open end 28 thereof, grasps the neck attachment member 16, and pulls the neck attachment member 16 through the open end 28, thereby inverting the pouch 14, and effectively containing the bib 10 within the pouch 14 thereof. Accordingly, the bib 10, including the bib body 12 and the neck attachment member 16, assumes a storage or transportation state, as shown in FIG. 10. It is to be understood that the forgoing steps serve as an exemplary embodiment of folding the bib 10. Accordingly, other folding methods may be utilized that would be encompassed by the scope of the invention.

Figure 11:
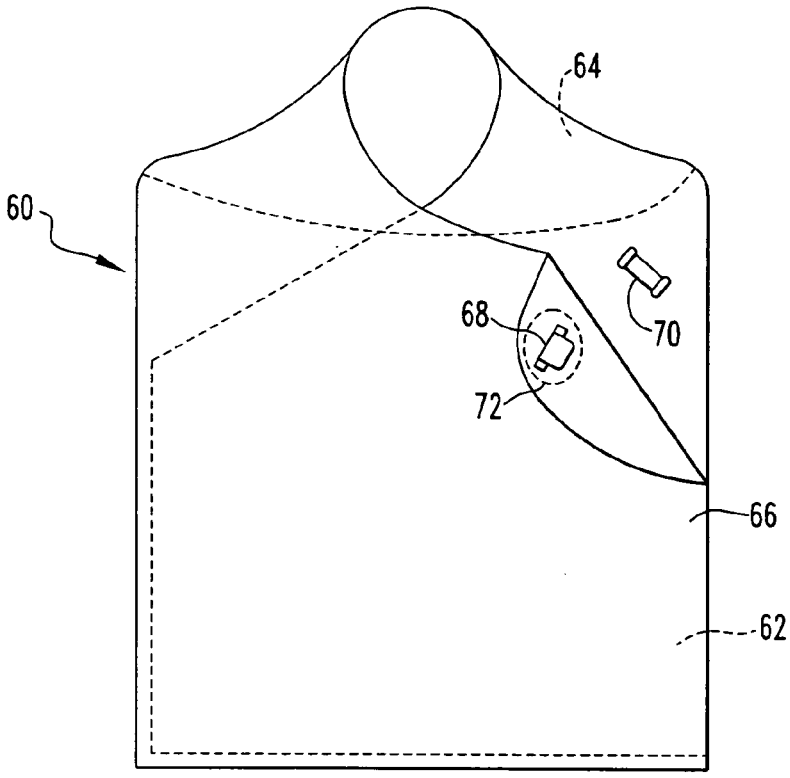
FIG. 11 is a front view of a second embodiment bib in accordance with the present invention.

An alternative embodiment of the present invention includes a bib vest 60, shown in FIG. 11. The bib vest 60 is constructed of a continuous piece of material or sections of material to create one continuous piece. The continuous piece of material is substantially elongated and rectangular in shape and includes a curved cut-out along a central lengthwise portion thereof. The continuous piece of material creates three portions: an underneath portion 62, a neck portion 64, and an outer portion 66. The continuous piece of material is of sufficient length to at least partially cover a front portion of an individual's torso (the underneath portion 62), then wrap behind the individual's neck (the neck portion 64), and then cover the uncovered front portion of the individual's torso (the outer portion 66), thereby at least partially overlapping the underneath portion 62. The neck portion 64 of the continuous piece of material may be thinner in width than the other portions 62 and 66 in order to accommodate the wrapping of the material around the back of the individual's neck.

Figure 14:
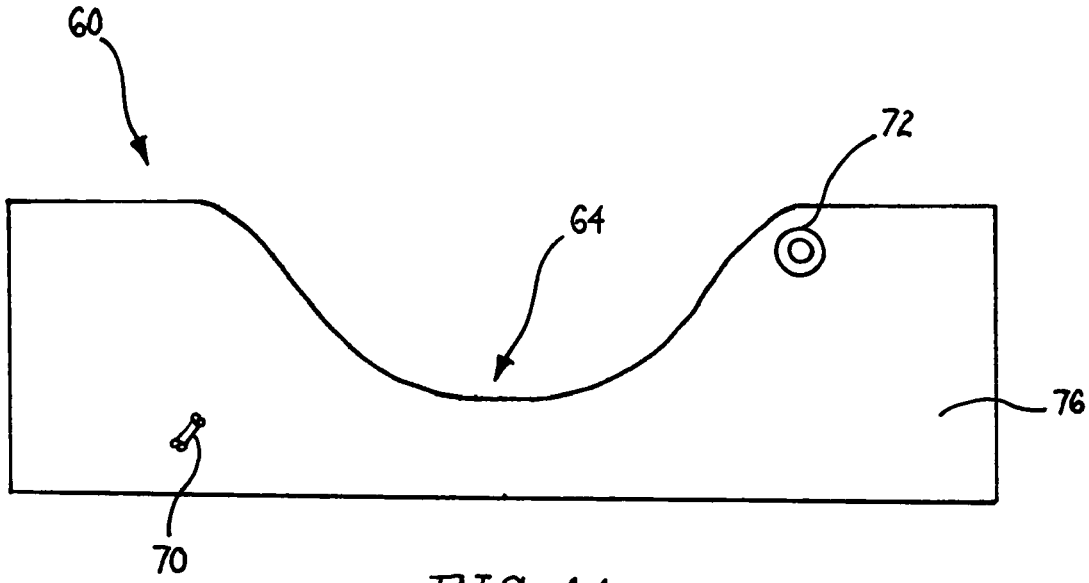
FIG. 14 is a front plan view of the bib shown in FIG. 11.
Figure 15:
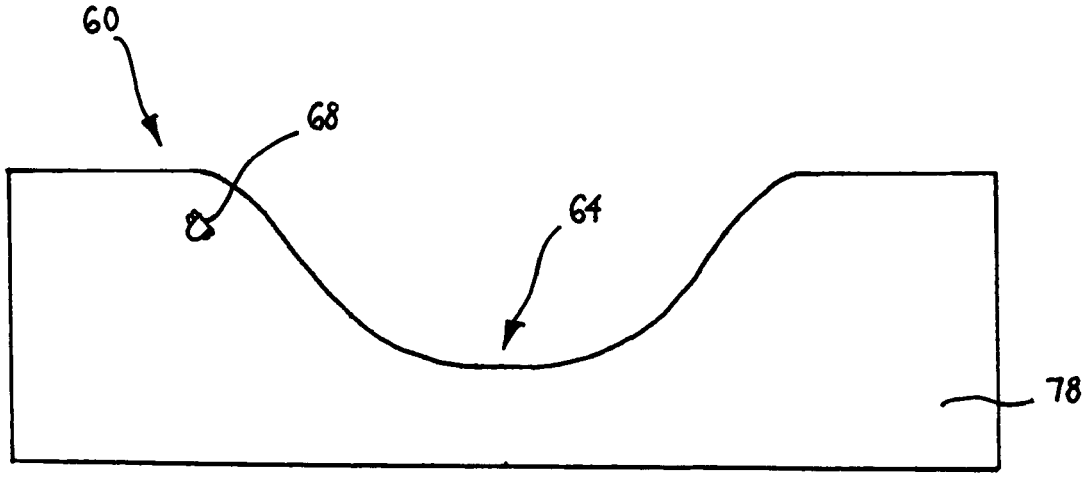
FIG. 15 is a rear plan view of the bib shown in FIG. 11.

The bib vest 60 includes corresponding fasteners, such as hook 68 and loop 70 fasteners, attached to the outer portion 66 and underneath portion 62, respectively. Specifically, once the bib vest 60 is wrapped around the individual, the hook 68 and loop 70 fasteners face each other and may be fastened together. The bib vest 60 may utilize the same or similar fasteners used in connection with the bib 10. As is shown in FIG. 11, the loop fastener 70 (or other suitable connector) is attached to a front surface of the underneath portion 62 and the hook fastener 68 (or other suitable connector) is attached to a rear surface of the outer portion 66. The loop fastener 70 and the hook fastener 68 are aligned and adapted to mate. A decorative button 72 or other object may be placed on the bib vest 60. As shown in FIG. 11, the decorative button 72 is situated on a front facing portion of the outer portion 66, whereas the hook 68 is situated on the opposite side thereof. Placement of the decorative button 72 in this position identifies the point where the hook 68 and loop 70 fasteners are located underneath the outer portion 66. This assists in more efficiently removing the bib vest 60. FIG. 14 shows a front surface of the bib vest 60 in an unfolded position and FIG. 15 shows the rear surface of the bib vest 60 in an unfolded position.

Figure 12:
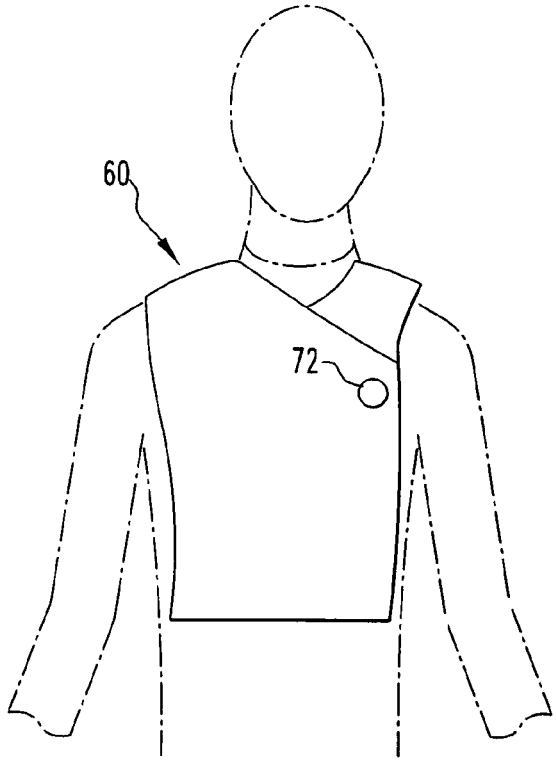
FIG. 12 is a front view of the bib of FIG. 11 as worn by the individual.

FIG. 12 depicts an individual wearing the bib vest 60. As shown, a portion of the bib vest 60 is wrapped around the neck of the individual and is then secured to itself via the covered hook 68 and loop 70 fasteners. Thus, the hook 68 and loop 70 fasteners are hidden and the more aesthetically pleasing decorative button 72 is visible.

Figure 13:
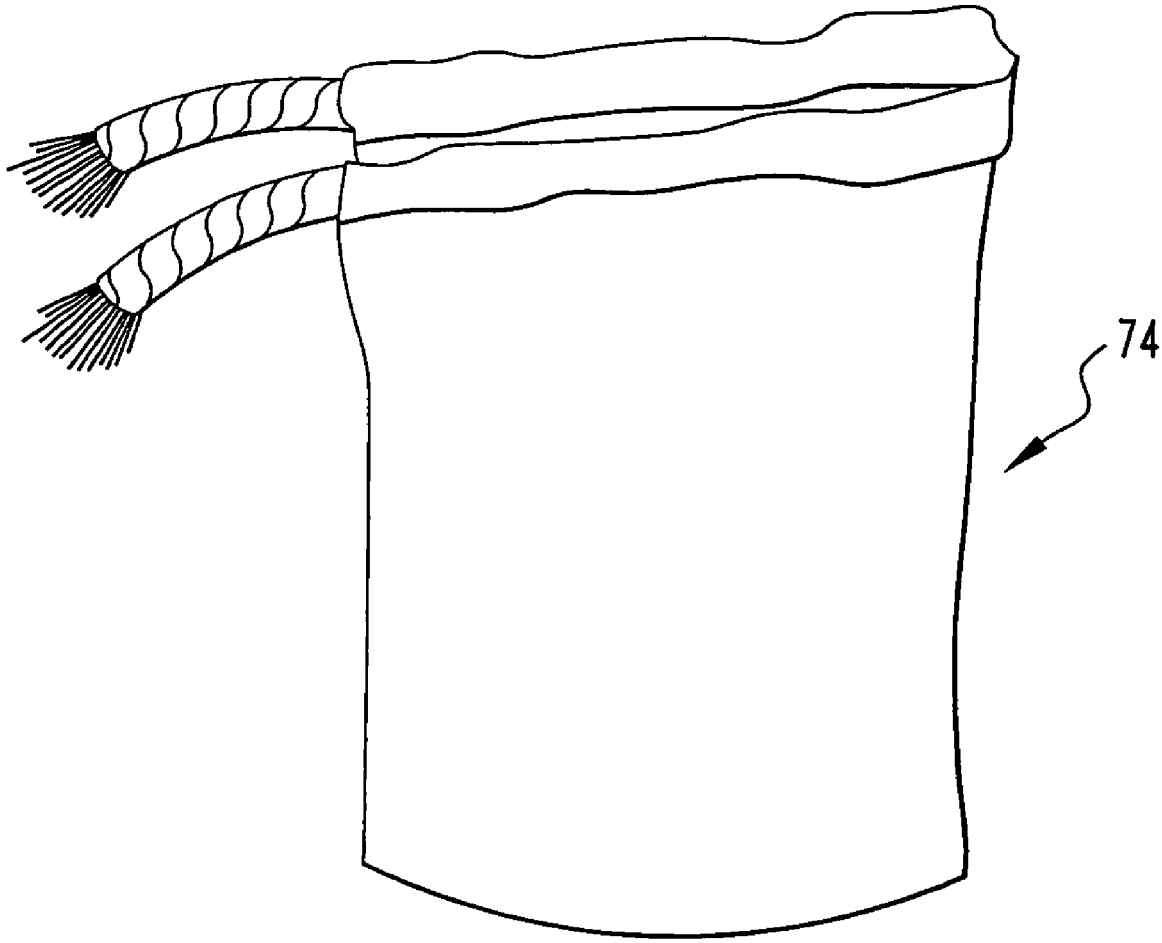
FIG. 13 is a front plan view of a pouch for storing the bib shown in FIG. 11.

The bib vest 60 may be constructed of the same material as the bib 10 and include similar decorations and designs. Furthermore, the bib vest 60 may be designed such that it is constructed of two different, yet coordinating fabrics, which allows for a reversible product. Thus, one side of the bib vest 60 may be more suitable for use with particular clothing the individual is wearing. Accordingly, the bib vest 60 is inherently versatile. When the bib vest 60 is not utilized, the bib vest 60 may be folded, stored and transported in a pouch 74, as shown in FIG. 13.

The invention has been described with reference to the desirable embodiments. Modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A bib comprising:

a bib body, including a front portion, at least partially attached to a rear portion and defining a cavity therein, and a top portion;

a pouch having a first side, a second side and an open end, wherein a portion of the first side of the pouch is attached substantially adjacent to an edge of the front portion of the bib body, and a portion of the second side of the pouch is attached substantially adjacent an edge of the rear portion of the bib body; and a neck attachment member secured to the top portion of the bib body and configured to engage a neck of a user, wherein the bib body and the neck attachment member are configured to be compacted and received within the pouch, and wherein the pouch is configured to be inverted to receive the bib body and the neck attachment member for storing and transporting the bib.

2. The bib of claim 1, wherein a left side of the front portion corresponds to a right side of the rear portion, and wherein a right side of the front portion corresponds to a left side of the rear portion.

3. The bib of claim 2, further comprising at least a first and second fastening connector, wherein the first fastening connector is secured to the right side of the front portion of the body and the second fastening connector is secured to a central portion of the front portion of the body, wherein the first fastening connector is adapted to mate with the second fastening connector.

4. The bib of claim 3, further comprising a third and fourth fastening connector, wherein the third fastening connector is secured to the left side of the front portion of the body and the fourth fastening connector is secured to the left side of the rear portion of the body, wherein the third fastening connector is adapted to mate with the fourth fastening connector.

5. The bib of claim 3, wherein at least one of the first and second fastening connectors is a corresponding snap fastener, magnet, button and button hole, hook and loop closure, or any combination thereof.

6. The bib of claim 1, further comprising a sleeve formed near the top portion, wherein the neck attachment member is partially received therethrough.

7. The bib of claim 6, wherein the neck attachment member is a partial loop having spring memory.

8. The bib of claim 7, wherein the neck attachment member is constructed of metal, plastic, rubber, fiber, or any combination thereof.

9. The bib of claim 1, wherein the pouch is adapted to move from a tucked position, where the pouch is situated within the cavity of the bib body, to an untucked position, where the pouch is situated in a position external to the cavity and the pouch extends from the bib body.

10. The bib of claim 1, wherein the top portion of the body is tapered.

11. The bib of claim 1, wherein the body is constructed of fabric having a decorative design.

12. A method of folding a bib for storage thereof, the method comprising the steps of:

providing a bib including a bib body having a top portion, a bottom portion and an integral pouch, wherein the integral pouch is adapted to receive the bib body therein, wherein the integral pouch includes an open end situated along the bottom portion, and the top portion is adapted to secure a neck attachment member thereto;

establishing a first fold line and a second fold line along the length of the bib body, wherein the first fold line is situated approximately two-thirds the distance of the width of the bib body, and wherein the second fold line is situated approximately one-third the distance of the width of the bib body;

folding a first side of the bib body along the first fold line;

folding a second side of the bib body along the second fold line to cause the second side of the bib body to overlap the first side of the bib body;

establishing a third fold line along the width of the bib body, wherein the third fold line is situated approximately one-third the distance from the top portion to the bottom portion;

inserting a hand into the integral pouch;

grasping the neck attachment member; and pulling the neck attachment member through the open end of the integral pouch, whereby the integral pouch is inverted and the bib is contained within the pouch.

13. The method of claim 12, further comprising the steps of:

fastening the first side of the bib body to a central portion of the bib; and fastening the second side of the bib body to the first side of the bib.

14. A bib comprising:

a bib body, including a front portion, at least partially attached to a rear portion and defining a cavity therein, and a top portion;

a pouch having a first side, a second side and an open end, wherein a portion of the first side of the pouch is attached substantially adjacent to an edge of the front portion of the bib body, and a portion of the second side of the pouch is attached substantially adjacent an edge of the rear portion of the bib body; and a neck attachment member secured to the top portion of the bib body and configured to engage a neck of a user, wherein the bib body and the neck attachment member are configured to be compacted and received within the pouch, wherein a left side of the front portion corresponds to a right side of the rear portion, and wherein a right side of the front portion corresponds to a left side of the rear portion, wherein the bib further comprises at least a first and second fastening connector, wherein the first fastening connector is secured to the right side of the front portion of the body and the second fastening connector is secured to a central portion of the front portion of the body, and wherein the first fastening connector is adapted to mate with the second fastening connector.

15. The bib of claim 14, further comprising a third and fourth fastening connector, wherein the third fastening connector is secured to the left side of the front portion of the body and the fourth fastening connector is secured to the left side of the rear portion of the body, wherein the third fastening connector is adapted to mate with the fourth fastening connector.

16. The bib of claim 14, wherein at least one of the first and second fastening connectors is a corresponding snap fastener, magnet, button and button hole, hook and loop closure or any combination thereof.

17. The bib of claim 14, further comprising a sleeve formed near the top portion, wherein the neck attachment member is partially received therethrough.

18. The bib of claim 17, wherein the neck attachment member is a partial loop having spring memory and is constructed of metal, plastic, rubber, fiber or any combination thereof.

19. The bib of claim 14, wherein the pouch is adapted to move from a tucked position, where the pouch is situated within the cavity of the bib body, to an untucked position, where the pouch is situated in a position external to the cavity and the pouch extends from the bib body.

20. The bib of claim 17, wherein the body is constructed of fabric having a decorative design.

* * * * *

UNITED STATES PATENT AND TRADEMARK OFFICE

CERTIFICATE OF CORRECTION

PATENT NO. : 7,269,855 B2
APPLICATION NO. : 11/231015
DATED : September 18, 2007
INVENTOR(S) : LaRocco It is certified that error appears in the above-identified patent and that said Letters Patent is hereby corrected as shown below:

Column 10, line 15, Claim 20, "The bib of claim 17" should read
-- The bib of claim 14 --

Signed and Sealed this

Twenty-fifth Day of December, 2007

JON W. DUDAS
*Director of the United States Patent and Trademark Office*